US011254455B2

(12) United States Patent
Siczek et al.

(10) Patent No.: US 11,254,455 B2
(45) Date of Patent: Feb. 22, 2022

(54) PACKAGING APPARATUS AND METHOD FOR WRAPPING ABSORBENT PAPER PRODUCT

(71) Applicant: The Procter & Gamble Company, Cincinnati, OH (US)

(72) Inventors: Pawel M. Siczek, Liberty Township, OH (US); Brian C. Schwamberger, Fairfield Township, OH (US); Gustav André Mellin, Amberly Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 206 days.

(21) Appl. No.: 16/355,929

(22) Filed: Mar. 18, 2019

(65) Prior Publication Data

US 2020/0299011 A1 Sep. 24, 2020

(51) Int. Cl.

| | |
|---|---|
| ***B65B 11/10*** | (2006.01) |
| ***B65B 5/02*** | (2006.01) |
| ***B65B 9/067*** | (2012.01) |
| ***B65B 11/02*** | (2006.01) |
| ***B65B 5/06*** | (2006.01) |

(52) U.S. Cl.

CPC ..... *B65B 11/105* (2013.01); *B65B 5/02* (2013.01); *B65B 5/06* (2013.01); *B65B 9/067* (2013.01); *B65B 11/02* (2013.01)

(58) Field of Classification Search

CPC ..... B65B 5/06; B65B 9/067; B65B 11/105
USPC ..... 53/450
See application file for complete search history.

(56) References Cited

U.S. PATENT DOCUMENTS

| | | | | |
|---|---|---|---|---|
| 4,430,844 | A | 2/1984 | James | |
| 4,658,569 | A * | 4/1987 | Hanagata | B65B 9/073 53/389.2 |
| 4,671,047 | A * | 6/1987 | Mugnai | B65B 61/005 53/550 |
| 4,679,379 | A * | 7/1987 | Cassoli | B65B 9/073 100/232 |
| 5,255,495 | A | 10/1993 | Kovacs | |

(Continued)

FOREIGN PATENT DOCUMENTS

EP 1652771 A1 5/2006

*Primary Examiner* — Thanh K Truong
*Assistant Examiner* — Xavier A Madison
(74) *Attorney, Agent, or Firm* — Richard L. Alexander; Charles R. Matson

(57) ABSTRACT

Aspects of the present disclosure relate to packaging apparatuses and methods adapted to wrap absorbent paper product in a continuous sheet of film formed into tube shape with an asymmetric opening. A former may include a plurality of forming members, wherein each forming member includes an outer surface connected with an inner surface along an edge. In operation, a continuous sheet of film advances around the edges of the forming members and forms an opening. In addition, opposing longitudinal edges of the continuous sheet are guided into an overlapping arrangement that forms the plastic film into a tube shape that extends downstream from the opening in the machine direction. The opening is symmetrical about a first axis and is asymmetrical about a second axis. Absorbent paper product to be packaged advances in the machine direction through the opening and into the tube.

36 Claims, 12 Drawing Sheets

(56) References Cited

U.S. PATENT DOCUMENTS

| | | | | |
|---|---|---|---|---|
| 5,921,067 | A * | 7/1999 | Fujiwara | B65B 7/10 53/136.5 |
| 7,356,978 | B2 * | 4/2008 | Dall'Omo | B65B 25/143 53/450 |
| 10,843,828 | B2 * | 11/2020 | Hyska | B65B 25/146 |
| 2007/0125242 | A1 * | 6/2007 | Dall'Omo | B65B 25/146 99/450.4 |
| 2008/0072545 | A1 * | 3/2008 | Kovacs | B65B 25/145 53/450 |
| 2010/0307114 | A1 * | 12/2010 | Spiekers | B65B 63/02 53/456 |
| 2012/0205272 | A1 * | 8/2012 | Heilman | B65D 75/38 206/386 |
| 2014/0318081 | A1 * | 10/2014 | Knopfel | B68G 9/00 53/450 |

* cited by examiner

PACKAGING APPARATUS AND METHOD FOR WRAPPING ABSORBENT PAPER PRODUCT

FIELD OF THE INVENTION

The present disclosure relates to apparatuses and methods for packaging absorbent paper products, and more particularly, to packaging apparatuses and methods for wrapping absorbent paper product in a continuous sheet of film formed into tube shape with an asymmetric opening.

BACKGROUND OF THE INVENTION

Rolled products, rolled absorbent products, and rolled fibrous products such as paper towels, toilet tissue, disposable shop towels, and wipes, for example, are sometimes packaged and shipped in bundles of a plurality of rolls. Packages are sometimes formed from a continuous sheet of plastic film. As such, some packaging apparatuses may include a former adapted guide the film such that opposing longitudinal edges of the continuous sheet are overlapped to form the plastic film into a tube shape that extends downstream from an opening in a machine direction. In turn, the rolled products may advance in the machine direction, through the opening, and into the tube shaped film that surrounds the rolled products to be wrapped. The overlapped longitudinal edges of the sheet may be sealed together and the tube shaped film may then be cut between consecutively bundled products and sealed into individual packages.

Some manufacturers may endeavor to create packages with relatively tightly wrapped film and relatively few wrinkles. As such, these manufactures may take various measures to configure packaging apparatuses and/or operations to manipulate the continuous sheet of film to achieve such desired results. For example, some packaging operations may: pre-stretch films prior to wrapping; utilize preformed bags; and/or force products through relatively smaller formers to help increase tightness of the film on the wrapped products.

In some configurations, the film may be guided around forming surfaces that help ensure equal tension and path length along a direction of travel to help reduce wrinkling. In addition, the former may be configured to create an opening that helps ensure equal film path across the forming surfaces to help prevent wrinkling and provide aesthetic bag forming. For example, in some configurations, the former may be configured to create an opening that is specifically shaped and sized to correspond with a shape and size of the particular product arrangements advancing through the opening and into the tube shaped film. In turn, such formers may include four corner edges about which the film is advanced, wherein the four corner edges are configured to form an opening that is symmetrical about a horizontal axis and a vertical axis extending perpendicular to the machine direction. Thus, the four corner edges of the former are also symmetrically shaped with respect to the two axes.

In some configurations, packaging devices may also be configured to compress products in a cross direction as the products advance through the tube shaped film to help increase bag tightness. For example, packaging devices may include a sealing member that extends in the machine direction that is configured to press advancing products in a cross direction as the products advance through the tube shaped film. In addition, the overlapped longitudinal edges of the film may be sealed together against a surface of the sealing member opposite a surface that presses against the advancing products. As such, the shape and/or size of the advancing products that engage the sealing member may be temporarily compressed and/or deformed so as to not correspond with the size and/or shape of the symmetrically formed opening. Therefore, in such an arrangement, the sheet of film may travel in a relatively longer distance to form an opening that is symmetrical about two axes than otherwise may be necessary to wrap around products that are compressed with the sealing member. With such packaging processes and apparatuses, relatively larger quantities of film may be used to wrap rolled products and/or the resulting packages may have relatively lower film tightness.

Consequently, there remains a need to apply plastic film to package rolled products while at the same time reducing the amount of film used; reducing wrinkles; and increasing film tightness.

SUMMARY OF THE INVENTION

In one form, a method for wrapping absorbent paper product comprises: providing a first forming member comprising a first edge, a second forming member comprising a second edge, a third forming member comprising a third edge, and a fourth forming member comprising a fourth edge; forming an opening by advancing a continuous sheet of film over the first, second, third, and fourth edges, wherein the opening comprises a first side and an opposing second side, and a third side and an opposing fourth side, wherein the opening is symmetrical about a first axis that bisects the first side and the second side, and wherein the opening is asymmetrical about a second axis that bisects the third side and the fourth side; providing a sealing member extending in a machine direction downstream from the opening; advancing absorbent paper product in the machine direction through the opening, wherein the continuous sheet of film is positioned between absorbent paper product and the third and fourth forming members, and wherein the sealing member is positioned between absorbent paper product and the continuous sheet of film; overlapping first and second edge regions of the continuous sheet of film on the sealing member; and bonding the first and second edge regions of the continuous sheet of continuous sheet of film together.

In another form, a packaging apparatus for forming a continuous sheet of film into a tube shape extending in a machine direction comprises: a first forming member comprising an outer surface connected with an inner surface along a first edge; a second forming member comprising an outer surface connected with an inner surface along a second edge; a third forming member comprising an outer surface connected with an inner surface along a third edge; a fourth forming member comprising an outer surface connected with an inner surface along a fourth edge; wherein the first, second, third, and fourth forming members are arranged so as to define an opening when film is folded over the first, second, third, and fourth edges; wherein the opening comprises a first side and an opposing second side, and a third side and an opposing fourth side; and wherein the opening is symmetrical about a first axis that bisects the first side and the second side, and wherein the opening is asymmetrical about a second axis that bisects third side and the fourth side.

In yet another form, a packaging apparatus for forming a continuous sheet of film into a tube shape extending in a machine direction comprises: a first forming member comprising an outer surface connected with an inner surface along a first edge; a second forming member comprising an outer surface connected with an inner surface along a second edge; a third forming member comprising an outer surface connected with an inner surface along a third edge; a fourth forming member comprising an outer surface connected with an inner surface along a fourth edge; wherein the first, second, third, and fourth forming members are arranged so as to define an opening when film is folded over the first, second, third, and fourth edges; wherein the opening comprises a first side and an opposing second side, and a third side and an opposing fourth side; and wherein the opening is symmetrical about a first axis that bisects the first side and the second side, and wherein the opening is asymmetrical about a second axis that bisects third side and the fourth side.

In still another form, a packaging apparatus for forming a continuous sheet of film into a tube shape extending in a machine direction comprises: a first forming member comprising a first edge; a second forming member comprising a second edge; a third forming member comprising a third edge; a fourth forming member comprising a fourth edge; wherein the first, second, third, and fourth edges are arranged to define an opening when film is folded over the first, second, third, and fourth edges; wherein the first edge and the second edge are symmetrical with respect to each other about a first axis extending between first edge and the second edge, and wherein the first edge and the third edge are asymmetrical with respect to each other about a second axis extending between the first edge and the third edge.

DETAILED DESCRIPTION OF THE INVENTION

The following term explanations may be useful in understanding the present disclosure:

The term "machine direction" (MD) is used herein to refer to the direction of material flow through a process. In addition, relative placement and movement of material can be described as flowing in the machine direction through a process from upstream in the process to downstream in the process.

The term "cross direction" (CD) is used herein to refer to a direction that is generally perpendicular to the machine direction.

Aspects of the present disclosure relate to packaging apparatuses and methods adapted to wrap absorbent paper product in a continuous sheet of film formed into tube shape with an asymmetric opening. As discussed below, a former may include a first forming member, a second forming member, a third forming member, and a fourth forming member, wherein each forming member includes an outer surface connected with an inner surface along an edge. In operation, absorbent paper product is advanced in a machine direction toward the forming members. At the same time, a continuous sheet of film advances in a second direction opposite the machine direction along the outer surfaces of the forming members to the respective edges thereof. The continuous sheet of film advances around the edges of the forming members and begins to advance in the machine direction. As the continuous sheet of film advances around the edges of the forming members, an opening is formed. In addition, opposing longitudinal edges of the continuous sheet are guided into an overlapping arrangement that forms the plastic film into a tube shape that extends downstream from the opening in the machine direction. The opening comprises a first side and an opposing second side, and a third side and an opposing fourth side. In addition, the opening is symmetrical about a first axis that bisects the first side and the second side. The opening is also asymmetrical about a second axis that bisects third side and the fourth side. The absorbent paper product to be packaged advances in the machine direction through the opening and into the tube shaped film. A sealing member that extends from the opening downstream in the machine direction compresses the absorbent paper product in the cross direction. As such, the continuous sheet of film is positioned between absorbent paper product and the third and fourth forming members, and the sealing member is positioned between absorbent paper product and the continuous sheet of film. The overlapped longitudinal edges of the film may then be sealed or bonded to each other on the sealing member. The film and absorbent paper products continue to advance in the machine direction wherein the film may be cut between consecutively bundled products and sealed into individual packages.

Figure 1B:
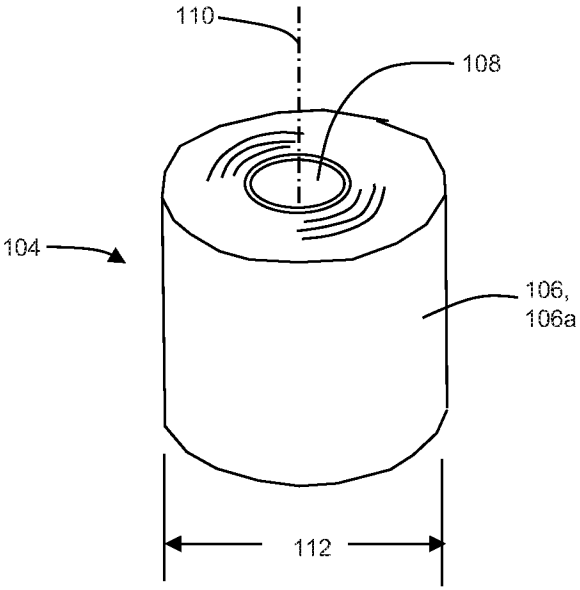
FIG. 1B is a simplified perspective view of a rolled paper product.
Figure 1A:
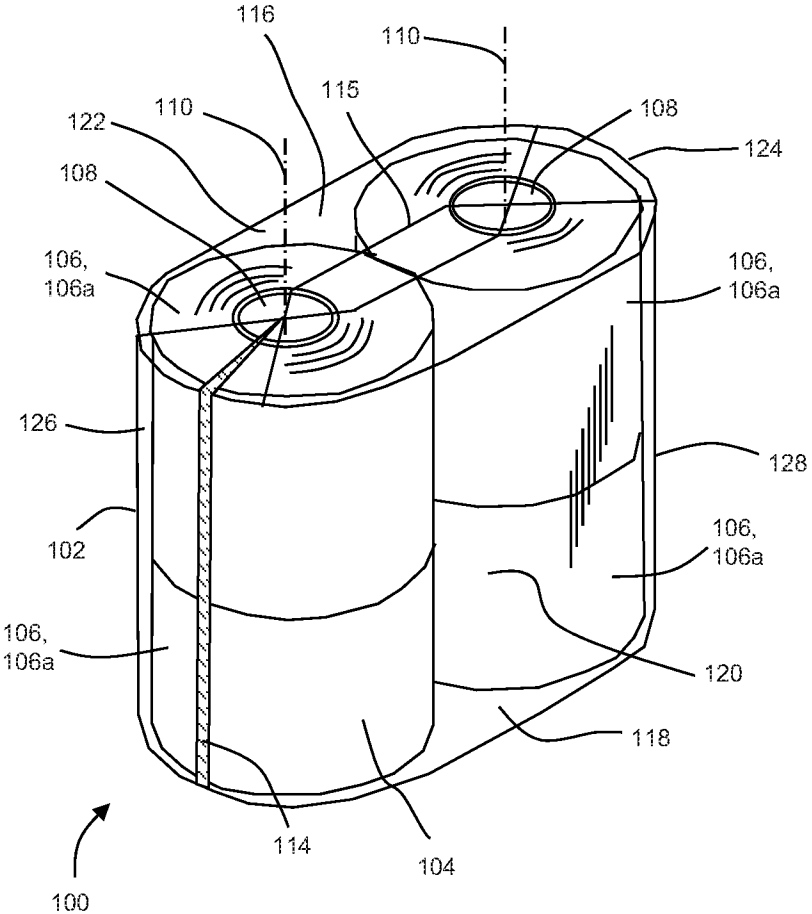
FIG. 1A is a simplified perspective view of a package including a container of absorbent paper product.

As discussed in more detail below, the packaging apparatuses and methods of packaging discussed herein are adapted to wrap a sheet of film around advancing absorbent paper product. For example, FIG. 1A shows a simplified perspective illustration of a package 100 that may include a container 102 of absorbent paper product 104. As shown in FIG. 1B, the absorbent paper product 104 may be configured as rolled paper product 106, rolled product, rolls of product, and/or rolls. "Rolled products" or "rolled paper products" or "rolls of product" or "rolls" within the present disclosure may include products made from cellulose fibers, nonwoven fibers, other suitable fibers, and combinations thereof. In some configurations, rolled products can be made of, or partially made of recycled fibers. Disposable rolled products or disposable rolled absorbent products or disposable rolled paper products may comprise paper towels, facial tissues, toilet tissues, shop towels, wipes, and the like, which may be made from one or more webs of fibers, such as cellulose fibers or nonwoven fibers, for example. Rolled paper products may comprises an absorbent towel substrate, a sanitary tissue substrate, or a cellulosic fiber containing substrate. With continued reference to FIG. 1B, each roll 106*a* of rolled paper product 106 may be wound about a paper, cardboard, paperboard, or corrugate tube to form a core 108 through each roll 106. Each core 108 may define a longitudinal axis 110 extending therethrough. In some configurations, the rolls 106*a* of rolled paper product 106 may not include the paper, cardboard, paperboard, or corrugate tube, but instead, the rolls of product may be wound about itself to form a roll while still forming a core defined through each roll. The void area in the center of each roll where the product winds about itself can be considered a "core" for purposes of this disclosure, although such rolls may be referred to as "coreless" rolls.

It is to be appreciated that rolled paper products 106 herein may be provided in various different sizes and may comprise various different roll diameters 112. For example, in some configurations, the roll diameter 112 of the rolled paper product 106 may be from about 4 inches to about 8 inches, specifically reciting all 0.5 inch increments within the above-recited ranges and all ranges formed therein or thereby. In some configurations, the roll diameter 112 of the rolled paper product 106 may be from about 6 inches to about 14 inches, specifically reciting all 0.5 inch increments within the above-recited ranges and all ranges formed therein or thereby. It is also to be appreciated that the rolled paper product 106 may comprise various different roll densities, which may be measured according to the Roll Density Test Method described herein. For example, in some configurations, the rolled paper product 106 may comprise a roll density greater than or equal to about 0.03 g/cm$^3$ and less than or equal to about 0.32 g/cm$^3$, specifically reciting all 0.01 g/cm$^3$ increments within the above-recited ranges and all ranges formed therein or thereby. In some configurations, the rolled paper product 106 may comprise a roll density greater than or equal to about 0.05 g/cm$^3$ and less than or equal to about 0.20 g/cm$^3$, specifically reciting all 0.01 g/cm$^3$ increments within the above-recited ranges and all ranges formed therein or thereby.

It is to be appreciated that the packaging apparatuses and methods herein may be configured to wrap film around the absorbent paper product to form various types of packing arrangements. For example, as shown in FIG. 1A, the containers 102 that house the absorbent paper product 104 may be formed from various types of material and may be configured in various shapes and sizes. In some configurations, the containers 102 may be formed from a poly film material that may comprise polymeric films, polypropylene films, and/or polyethylene films. The container 102 may be formed by wrapping a film material around one or more absorbent paper products 104 to conform with the shapes of individual products and/or arrangements of products. As shown in FIG. 1A, the container 102 may also include a side seal 114 and an end seal 115, such as an envelope seal, for example, formed thereon. As shown in FIG. 1A, the container 102 may include a top side 116 and a bottom side 118. The container may also include a front panel 120 and a rear panel 122, wherein the front and rear panels 120, 122 are connected with and separated by opposing first and second sides 124, 126. The front panel 120, the rear panel 122, the first side 124, and/or the second side 126 may be substantially planar, curved, or convex as shown in FIG. 1A and may also define an outer surface 128 of the container 102.

Figure 1D:
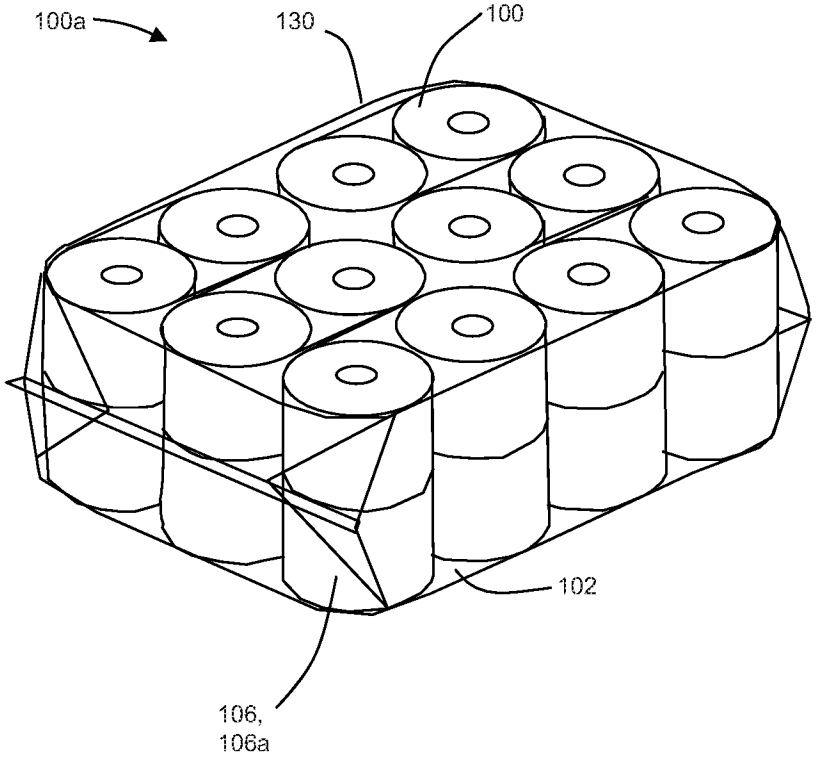
FIG. 1D is a simplified perspective view of a large count package including individually wrapped packages of absorbent paper product.
Figure 1C:
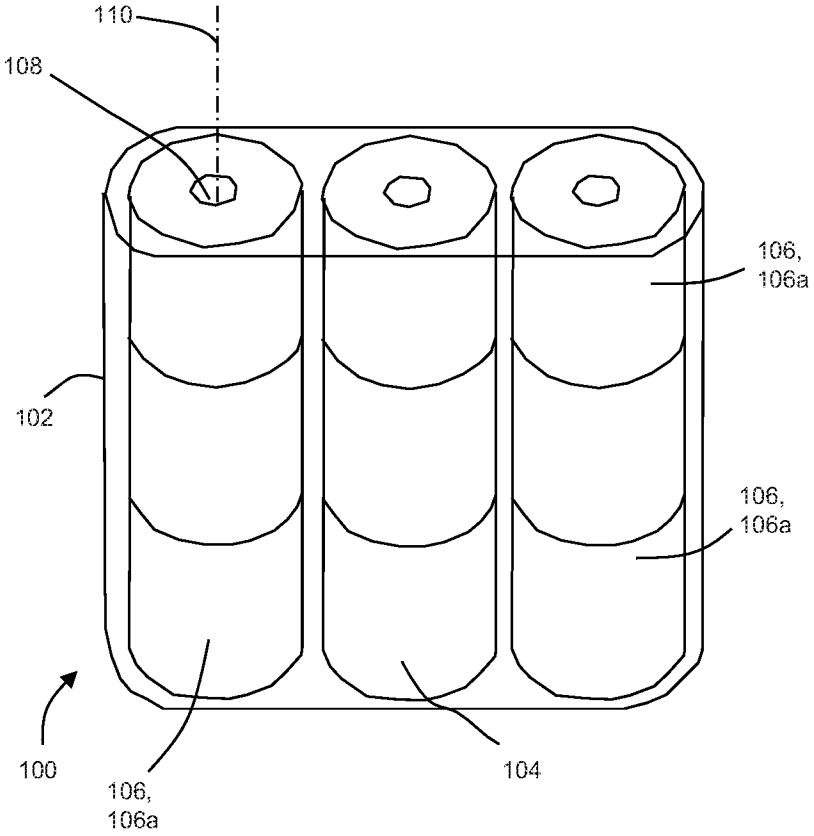
FIG. 1C is a simplified perspective view of a second package including a container of absorbent paper product.

It is to be appreciated that the packages 100 may include various quantities of absorbent paper products 104 that may be arranged in various orientations within the containers 102. For example, as shown in FIG. 1A, an individually wrapped package 100 may include four rolls 106*a* of rolled paper product 106 inside a container 102, wherein two rolls 106*a* are stacked on another two rolls 106*a*. The longitudinal axis 110 of each of the cores 108 of each stack of at least two rolls 106*a* may be generally parallel and aligned with each other and adjacent stack(s) of at least two rolls 106*a* can lie in generally the same plane as the other stack(s) of at least two rolled paper products 106. In another example, shown in FIG. 1C, an individually wrapped package 100 may include nine rolls 106*a* of rolled paper product 106 arranged in stacks inside the container 102. It is to be appreciated that multiple rolls 106*a* of rolled paper product 106 can be enclosed in a container 102 constructed from a polymer film or other suitable material that may be sealed to form individually wrapped packages 100. In some configurations, individually wrapped packages 100 of the two or more rolls 106*a*, or stacks of rolls 106*a*, may be bundle and/or bound together within an overwrap 130 forming a container 102 to define a large count package 100*a*, such as shown in FIG. 1D. In some configurations, large count packages 100*a* may contain a plurality of "naked," (i.e., unwrapped) rolls 106*a* of rolled paper product 106. In some configurations, the individually wrapped packages or naked rolls may be stacked or positioned together into a generally cuboid-shaped container 102, such as disclosed in U.S. Patent Publication No. 2012/0205272 A1, which is incorporated by reference herein. It is to be appreciated that packages 100 can each comprise one or more rolls 106*a* of rolled paper product 106, such as for example, two, three, four, six, eight, nine, ten, twelve, or fifteen rolls 106*a* of rolled paper product 106.

Figure 2:
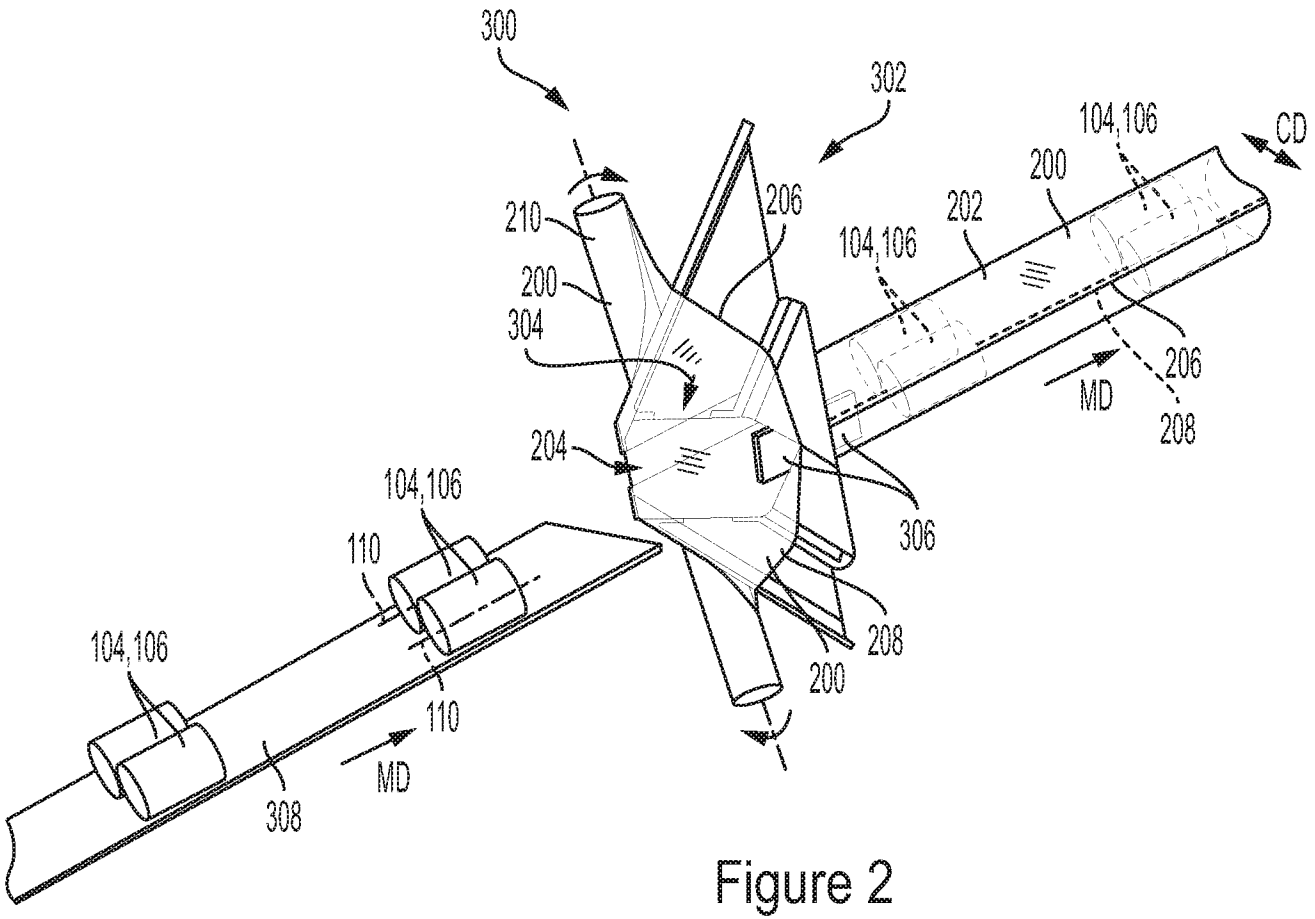
FIG. 2 is an isometric schematic view of absorbent paper product in a first orientation advancing through a packaging apparatus.
Figure 3:
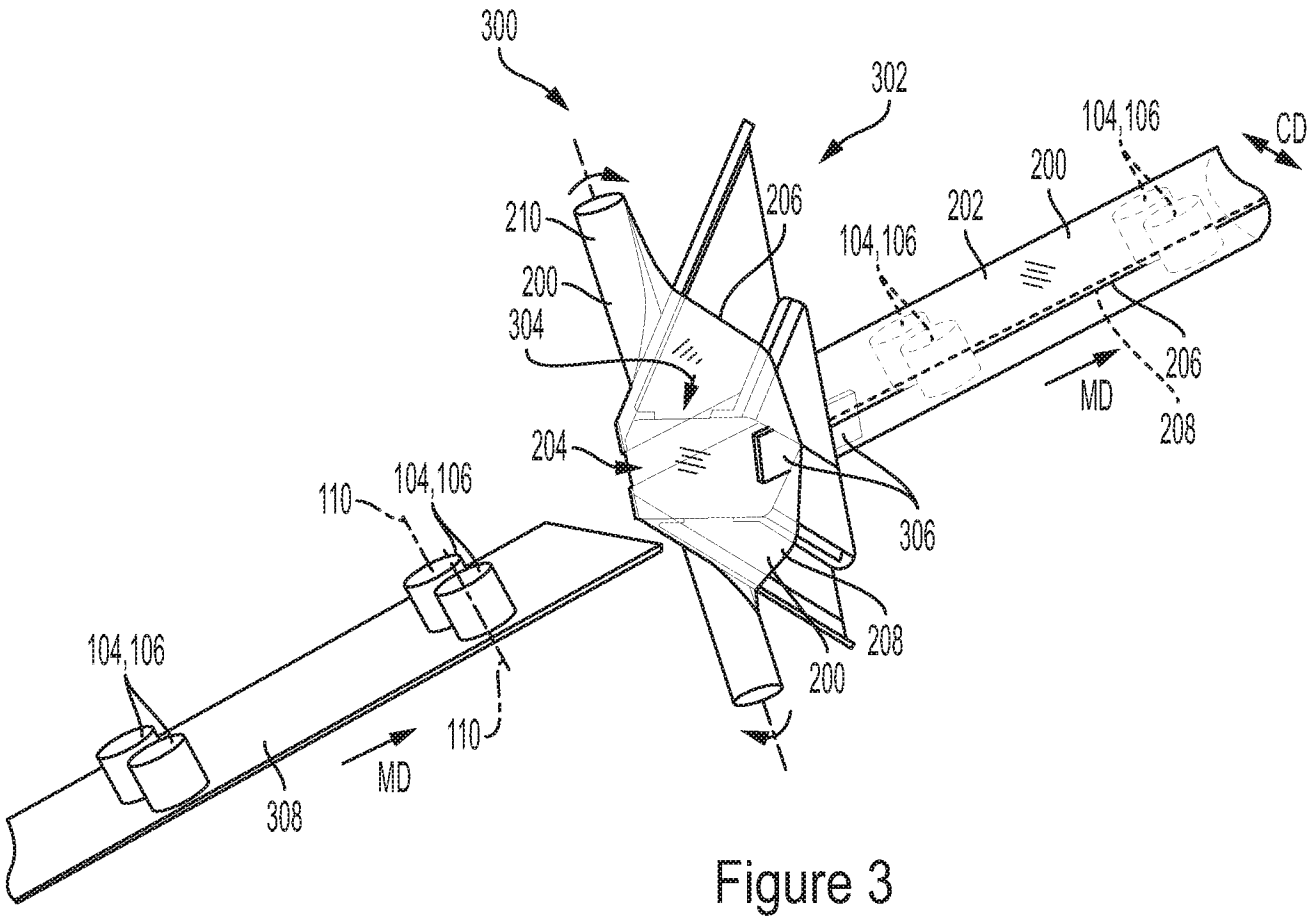
FIG. 3 is an isometric schematic view of absorbent paper product in a second orientation advancing through a packaging apparatus.

As previously mentioned, the packaging apparatuses and methods herein are adapted to wrap absorbent paper product in a continuous sheet of film to form various arrangements and configurations of packages 100, such as described above for example. FIGS. 2 and 3 show a schematic illustration of a packaging apparatus 300 that includes a former 302 configured to form a continuous sheet of film 200 into a tube 202 with an opening 204 that is asymmetrically shaped. During the packaging process, rolled paper product 106 may advance in a machine direction MD toward the former 302. At the same time, a continuous sheet of film 200 that includes a first longitudinal edge 206 and an opposing second longitudinal edge 208 may be unwound from a roll 210 and advanced onto the former. The film 200 may be directed onto outer surfaces of the former 302 and may advance in a second direction 304 that is opposite the machine direction MD along outer surfaces of the former 302. The film 200 advances around edges on the former 302 and is redirected to advance in the machine direction MD. In addition, the former 302 guides the first longitudinal edge 206 and the second longitudinal edge 208 of the film 200 into an overlapping arrangement that in turn, forms the film 200 into a tube 202 that extends in the machine direction MD downstream from an opening 204. The overlapped longitudinal edges 206, 208 of the film 200 are then sealed or bonded to each other while being held against a sealing member 306 that extends from the opening 204 downstream in the machine direction MD. Although not illustrated, the rolled paper product 106 and surrounding film 200 continue to advance in the machine direction MD wherein the film 200 may be cut between consecutively bundled products and sealed into individual packages 100.

With continued reference to FIGS. 2 and 3, the rolled paper product 106 advances in the machine direction MD, through the opening 204, and into the tube 202 of film 200. Although a single conveyor 308 is schematically illustrated in FIGS. 2 and 3, it is to be appreciated that the packaging apparatus 300 may include various types, quantities, and arrangements of conveyance devices configured to advance the rolled paper product to the former 302, through the opening 204, and into the tube 202 of film 200, such as disclosed for example in U.S. Pat. Nos. 4,430,844 and 5,255,495 and European Patent Publication No. EP 1652771 A1, which are all incorporated by reference herein. It is also to be appreciated that the rolled paper product 106 may be oriented in various ways while being conveyed. For example, the rolled paper product 106 may be oriented such that the longitudinal axes 110 are parallel with the machine direction MD, such as shown FIG. 2. In another example, the rolled paper product 106 may be oriented such that the longitudinal axes 110 are vertically oriented and/or perpendicular to the machine direction MD, such as shown FIG. 3. It is also to be appreciated that pluralities of rolled paper products 106 may be stacked upon one another vertically, horizontally along the cross direction CD, and/or along the machine direction MD while advancing to the former 302, through the opening 204, and into the tube 202 of film 200.

As discussed in more detail below, the former 302 is adapted to guide the film 200 so as to create an opening 204 to the tube 202 having a shape that is symmetrical about one axis and asymmetrical about another axis. As such, it is to be appreciated that the former 302 may be configured in various ways and may include various quantities and/or arrangements of forming members 310, such as shown for example in FIGS. 4A and 5A. For example, as shown in FIGS. 4A-5B, the former 302 may include a first forming member 310*a*, a second forming member 310*b*, a third forming member 310*c*, and a fourth forming member 310*d*. The first forming member 310*a* comprises an outer surface 312*a* connected with an inner surface 314*a* along a first edge 316*a*; the second forming member 310*b* comprises an outer surface 312*b* connected with an inner surface 314*b* along a second edge 316*b*; the third forming member 310*c* comprises an outer surface 312*c* connected with an inner surface 314*c* along a third edge 316*c*; and the fourth forming member 310*d* comprises an outer surface 312*d* connected with an inner surface 314*d* along a fourth edge 316*d*. As discussed in more detail below, the film 200 advances over the outer surfaces 312 of the forming members 310 and is folded over the respective edges 316 to define the asymmetrical opening 204 of the tube 202.

Figure 4A:
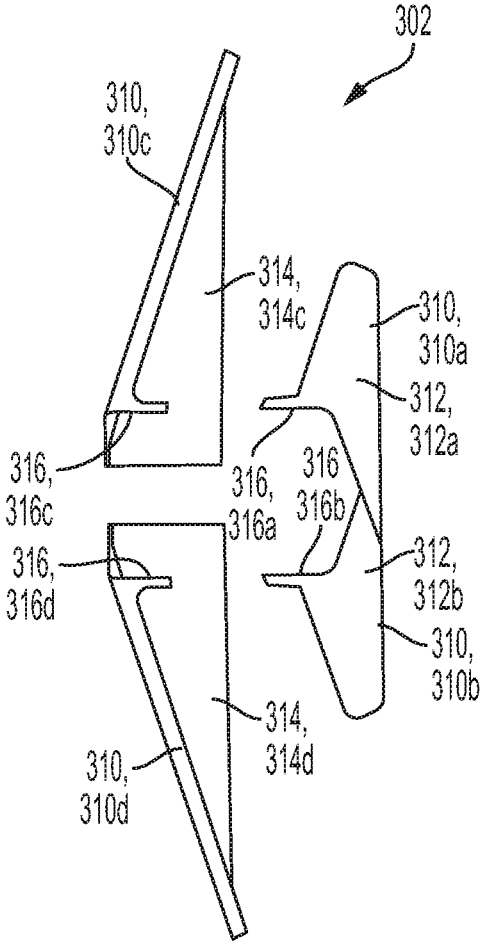
FIG. 4A is a right side isometric view of a former.
Figure 4B:
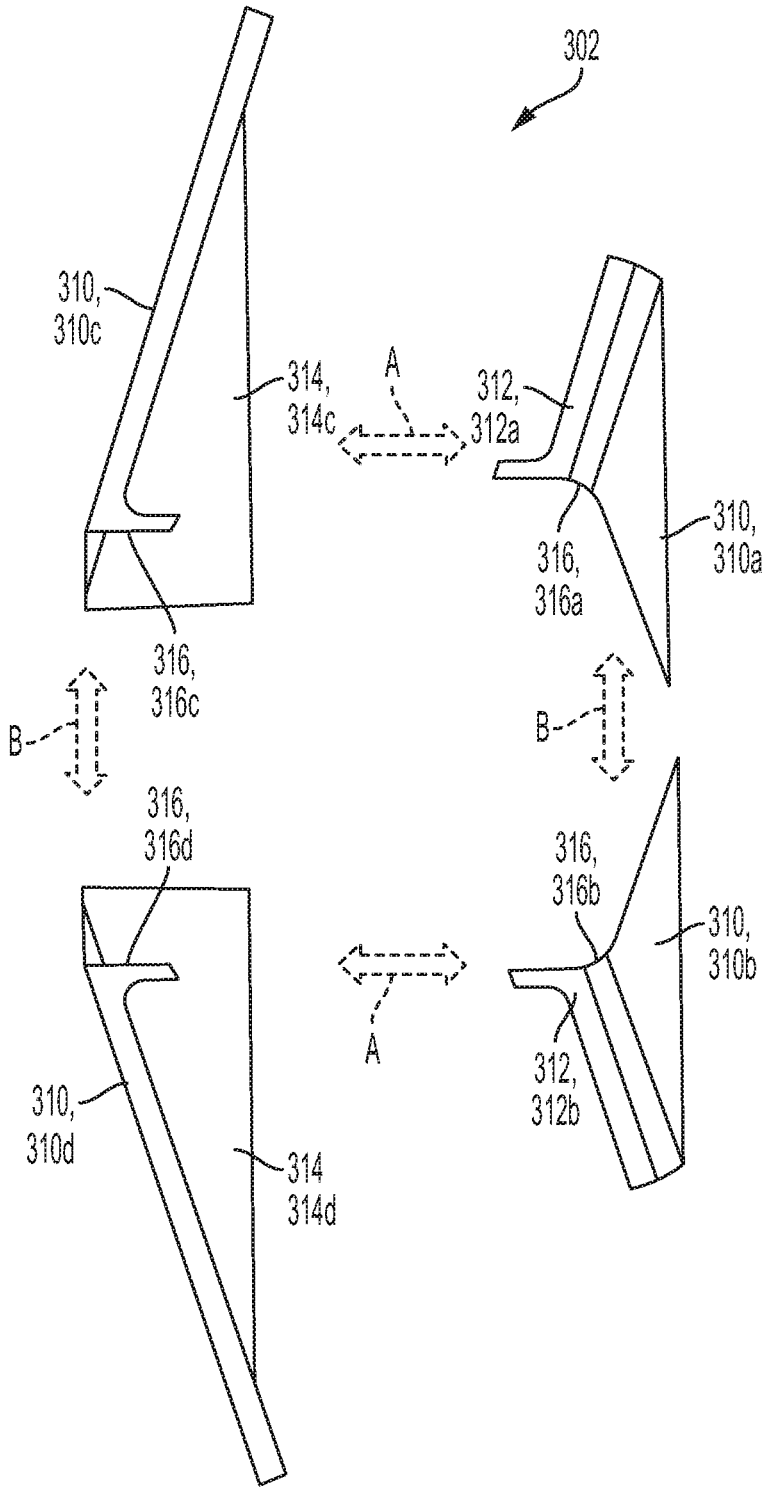
FIG. 4B is an exploded detailed view of the former shown in FIG. 4A.
Figure 5A:
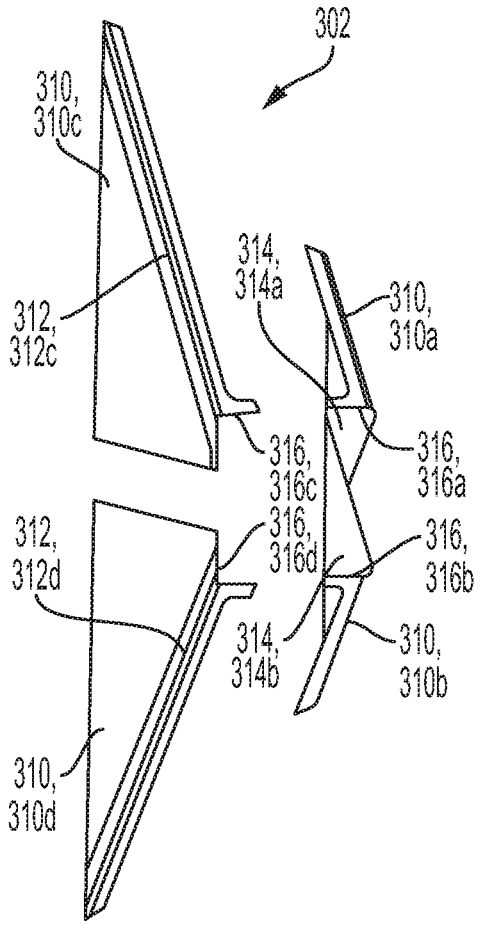
FIG. 5A is a left side isometric view of the former of FIG. 4A
Figure 5B:
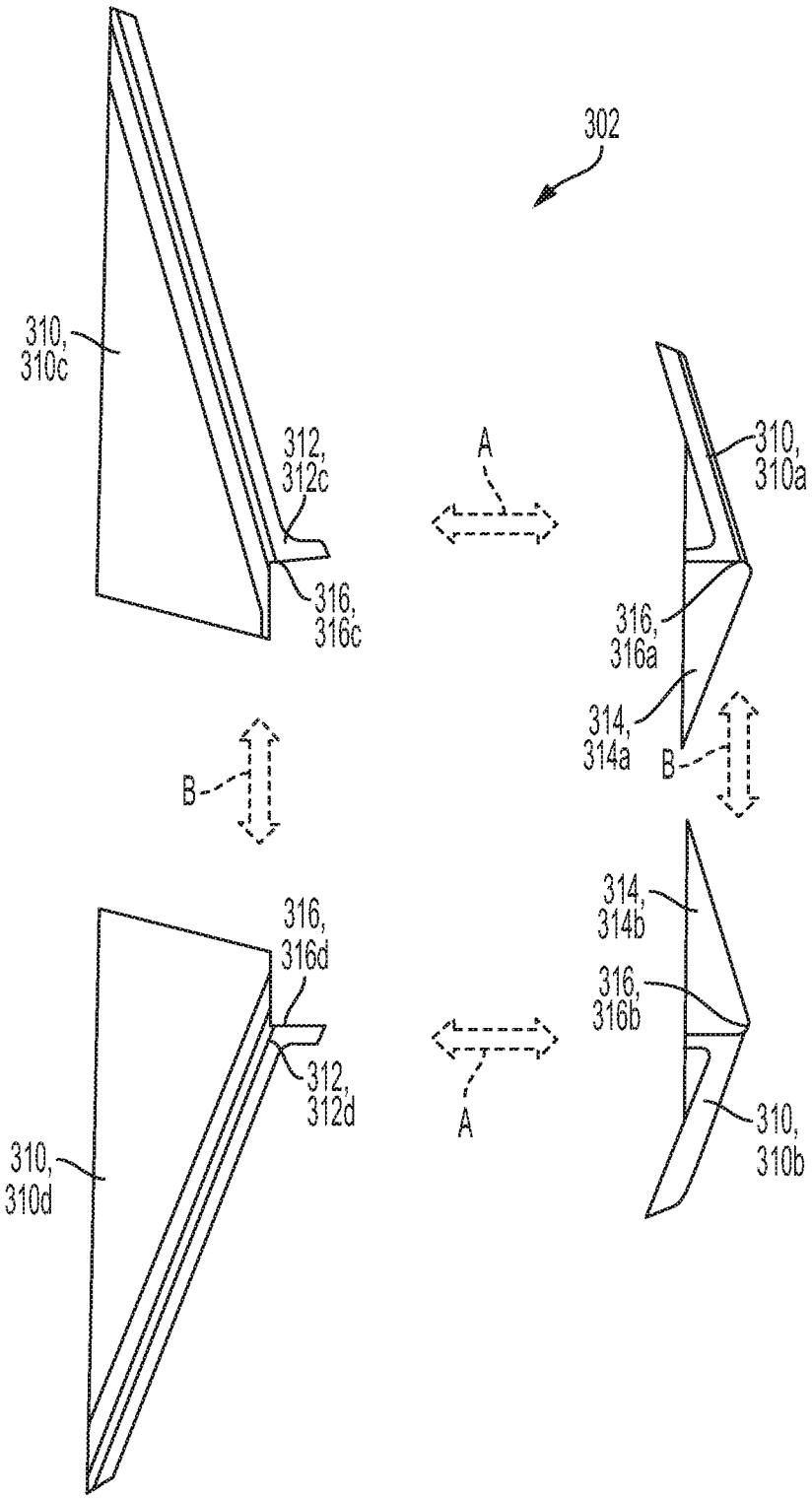
FIG. 5B is an exploded detailed view of the former shown in FIG. 5A.

In some configurations, forming members 310 may be configured such that respective edges 316 may be separated from each other by a gap. For example, such as shown in FIGS. 4A and 5A, the first edge 316*a* may be separated from the third edge 316*c* by a gap extending in the cross direction CD, and the second edge 316*b* may be separated from the fourth edge 316*d* by a gap extending in the cross direction CD. In addition, the third edge 316*c* may also be separated from the fourth edge 316*d* by a gap. It is also to be appreciated that two or more forming members 310 may be configured such that respective edges 316 may abut or overlap with each other so as to define a contiguous edge that extends between adjacent forming member members 310.

It is to be appreciated that the former 302 may be configured in various ways to allow a user to selectively change the size and/or shape of the opening 204 to accommodate different shapes, orientations, and/or sizes of absorbent paper product 104 being packaged. For example, the former 302 may be configured such that the first member 310*a*, second forming member 310*b*, third forming member 310*c*, and fourth forming member 310*d* are movable relative to each other, such as represented by the directional arrows A and B in FIGS. 4B and 5B.

Figure 5C:
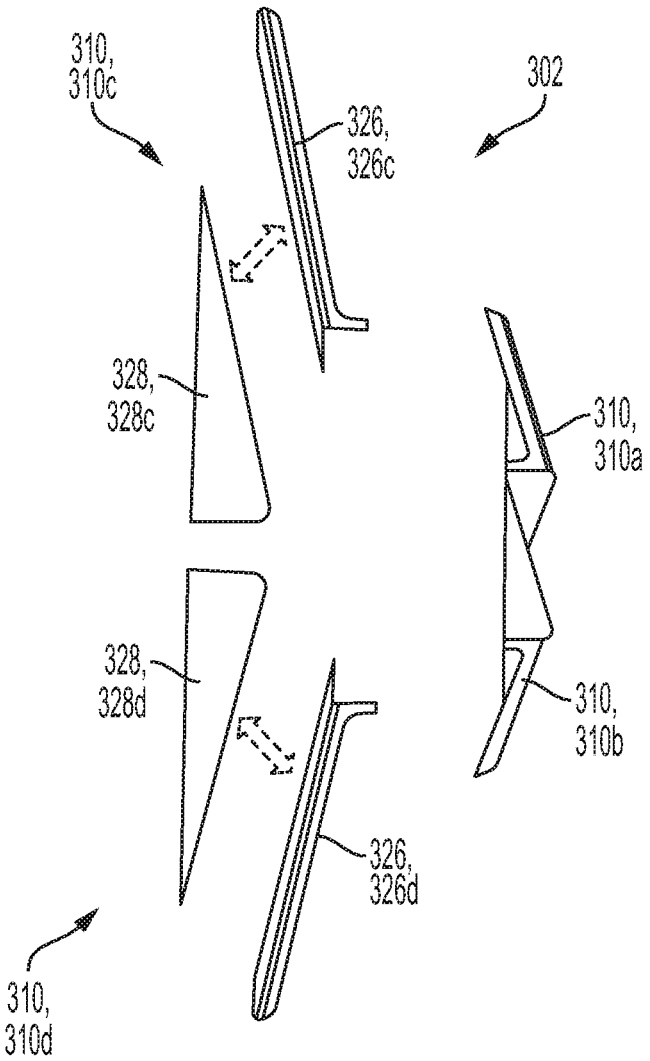
FIG. 5C is an exploded detailed view of the former shown in FIG. 5A including corner members releasably connected with base members.

In some configurations, one or more forming members 310 may be configured to include a corner member 326 releasably connected with a base member 328. For example, as shown in FIG. 5C, the third forming member 310*c* may include a corner member 326*c* releasably connected with a base member 328*c*, and the fourth forming member 310*d* may include a corner member 326*c* releasably connected with a base member 328*c*. As such, in a first configuration, the first edge 316*a*, second edge 316*b*, third edge 316*c*, and fourth edge 316*d* may be arranged to define a first opening 204 when film 200 is folded over the first edge 316*a*, second edge 316*b*, third edge 316*c*, and fourth edge 316*d*. In a second configuration, the third corner member 326*c* and the fourth corner member 326*d* may be removed and replaced with a third replacement corner member 326*c* and a fourth replacement corner member 326*d*. The third replacement corner member 326*c* may comprise a third replacement edge 316*c* and the fourth replacement corner member 326*d* may comprise a fourth replacement edge 316*d*. As such, the first edge 316*a*, second edge 316*b*, third replacement edge 316*c*, and fourth replacement edge may be arranged to define a second opening 204 having a different size and/or shape than the first opening 204 when film 200 is folded over the first edge 316*a*, second edge 316*b*, third replacement edge 316*c*, and fourth replacement edge 316*d*. It is to be appreciated that the corner members 326 may be releasably connected with the base members 328 in various ways to help a user to remove and replace the corner members to 326 to relatively easily and quickly change the shape and/or size of the opening 204 without having to remove and replace the entire forming members 310*c*, 310*d*. For example, corner members 326 may be releasably connected with the base members 328 with magnets, latch mechanisms, clamps, and/or bolts.

Figure 7:
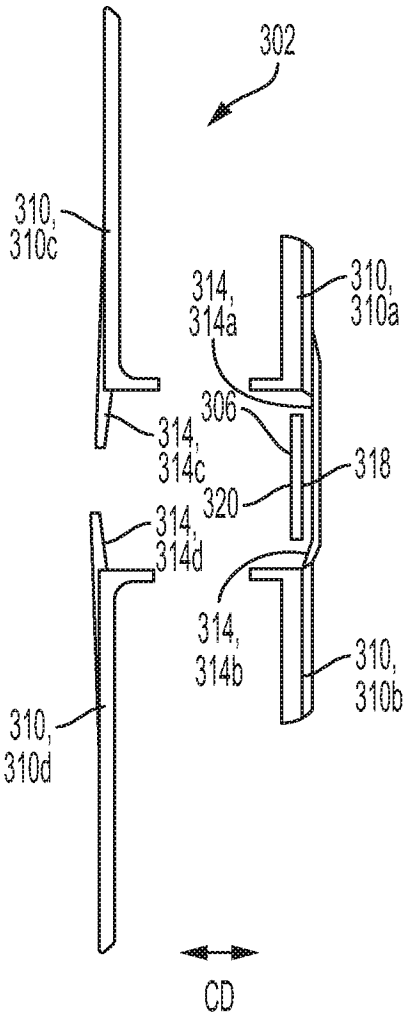
FIG. 7 is a front side view of the sealing member and former of FIG. 6 looking downstream in a machine direction MD.
Figure 6:
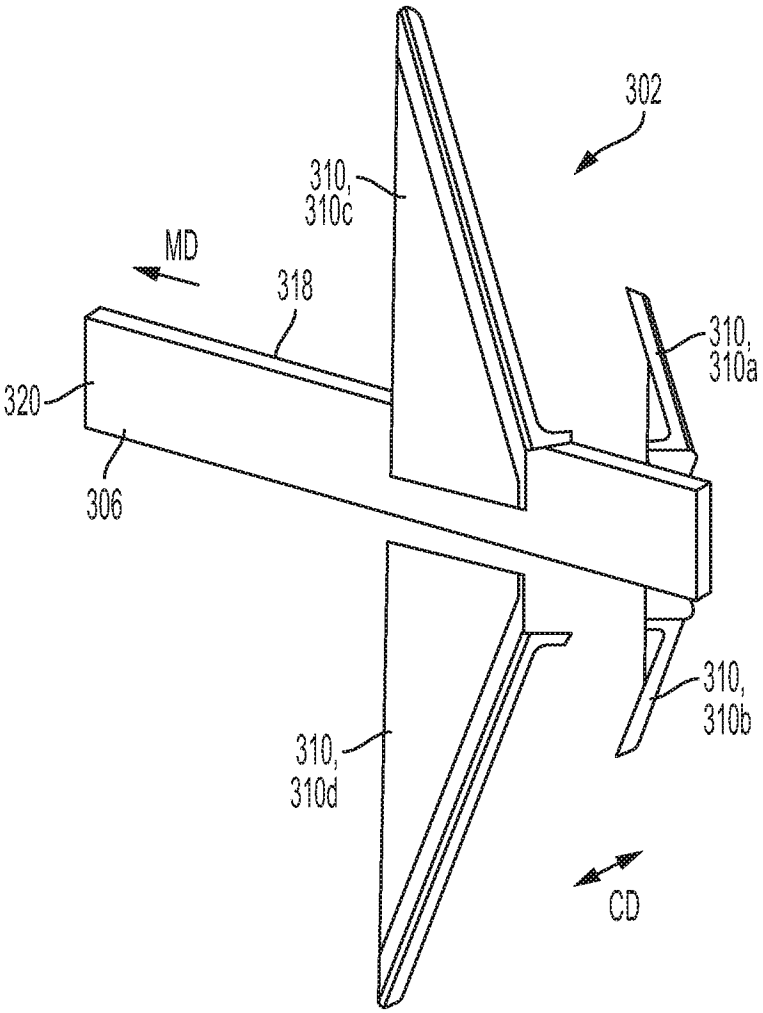
FIG. 6 is a left side isometric view of a sealing member and former.

As previously mentioned with reference to FIGS. 2 and 3, the packaging apparatus 300 may include a sealing member 306 that extends from the opening 204 downstream in the machine direction MD. As shown in FIGS. 6 and 7, the sealing member 306 may include a first surface 318 and an opposing second surface 320. The sealing member 306 may be oriented with respect to the former 302 such that the first surface 318 may be in a facing relationship with the inner surfaces 314*a*, 314*b* of the first forming member 310*a* and the second forming member 310*b*, and the second surface 320 may be in a facing relationship with the inner surfaces 314*c*, 314*d* of the third forming member 310*c* and the fourth forming member 310*d*. During operation, the overlapped longitudinal edges 206, 208 of the film 200 may be sealed or bonded to each other while advancing along the first surface 318 of the sealing member 306. In addition, the sealing member may be oriented such that rolled paper product 106 advancing through the opening 204 and into the tube 202 contact the second surface 320 of the sealing member 306. In turn, the second surface 320 of the sealing member 306 may deflect the rolled paper product 106 in the cross direction toward the inner surfaces 314*c*, 314*d* of the third forming member 310*c* and the fourth forming member 310*d*. As such, the sealing member 306 may compress the advancing the rolled paper product 106 in the cross direction CD. It is to be appreciated that the rolled paper product 106 may be temporality compressed or deformed in the cross direction CD by the sealing member 306, and as such, may expand in the cross direction CD downstream of the sealing member 306 to return to substantially the same shape upstream of the sealing member 306.

Figure 8A:
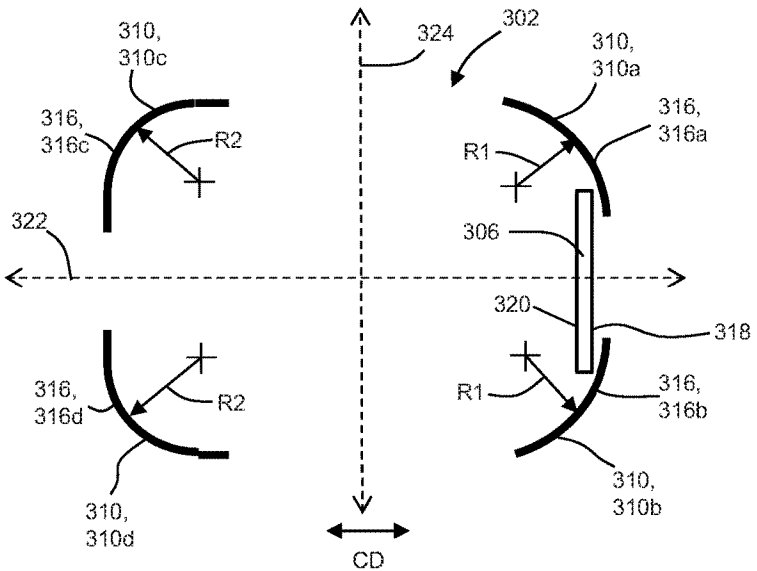
FIG. 8A is a schematic illustration showing first, second, third, and fourth edges of first, second, third, and fourth forming members, respectively, viewed when looking downstream in the machine direction MD.

As previously mentioned, the former 302 may include forming members 310 configured to guide the film 200 to define an opening 204 of the tube 202 of film 200 that is symmetrical about one axis and asymmetrical about another axis. For example, FIG. 8A is a schematic illustration showing the first edge 316*a*, second edge 316*b*, third edge 316*c*, and fourth edge 316*d* of the first forming member 310*a*, second forming member 310*b*, third forming member 310*c*, and fourth forming member 310*d*, respectively, as viewed when looking downstream in the machine direction MD. As shown in FIG. 8A, the forming members 310 may be shaped such that the first edge 316*a* and the second edge 316*b* may be symmetrical with respect to each other about a first axis 322 extending between first edge 316*a* and the second edge 316*b*, and the third edge 316*c* and the fourth edge 316*d* may be symmetrical with respect to each other about the first axis 322 extending between third edge 316*c* and the fourth edge 316*d*. In addition, the first edge 316*a* and the third edge 316*c* may be asymmetrical with respect to each other about a second axis 324 extending between the first edge 316*a* and the third edge 316*c*. In addition, the second edge 316*b* and the fourth edge 316*d* may be asymmetrical with respect to each other about the second axis 324 extending between the second edge 316*b* and the fourth edge 316*d*.

As shown in FIG. 8A, the first edge 316*a* of the first forming member 310*a* may define a first shape, and the second edge 316*b* of the second forming member 310*b* may define a second shape. The first shape and the second shape may be symmetrical with respect to the first axis 322. Similarly, the third edge 316*c* of the third forming member 310*c* may define a third shape, and the fourth edge 316*d* of the fourth forming member 310*d* may define a fourth shape. The third shape and the fourth shape may also be symmetrical with respect to the first axis 322. In turn, the first shape and the third shape may be asymmetrical with respect to the second axis 324, and the second shape and the fourth shape may be asymmetrical with respect to the second axis 324. It is to be appreciated that the first axis 322 and second axis 324 may extend in various angular orientations with respect to the machine direction MD and/or the cross direction CD. For example, the first axis 322 and the second axis 324 may be perpendicularly oriented with respect to the machine direction MD. In some examples, the first axis 322 and/or the second axis 324 may be vertically oriented, horizontally oriented, or angularly offset from horizontal and vertical orientations.

It is to be appreciated that the first edge 316*a*, second edge 316*b*, third edge 316*c*, and fourth edge 316*d* may define various shapes and sizes. For example, the first edge 316*a*, second edge 316*b*, third edge 316*c*, and/or fourth edge 316*d* may define shapes that are equivalent to a shaped defined by an intersection of two perpendicular lines, such as a 90° corner of a square or rectangle. As shown in FIG. 8A, the first edge 316*a*, second edge 316*b*, third edge 316*c*, and/or fourth edge 316*d* may define shapes that are curved or arcuate. As such, the first edge 316*a* and the second edge 316*b* may each comprise a first radius, R1, of curvature; and the third edge 316*c* and the fourth edge 316*d* may each comprise a second radius, R2, of curvature, wherein the first radius, R1, of curvature is not equal to the second radius, R2, of curvature. In some configurations, a ratio of the second radius R2 of curvature of the third and fourth edges 316*c*, 316*d* to the first radius R1 of curvature of the first and second edges 316*a*, 316*b* is greater than or equal to about 0.3 and less than 1.0, specifically reciting all 0.05 increments within the above-recited ranges and all ranges formed therein or thereby. In some configurations, a ratio of the second radius R2 of curvature of the third and fourth edges 316*c*, 316*d* to the first radius R1 of curvature of the first and second edges 316*a*, 316*b* is greater than 1.0 and less than or equal to about 1.5, specifically reciting all 0.05 increments within the above-recited ranges and all ranges formed therein or thereby.

Figure 8B:
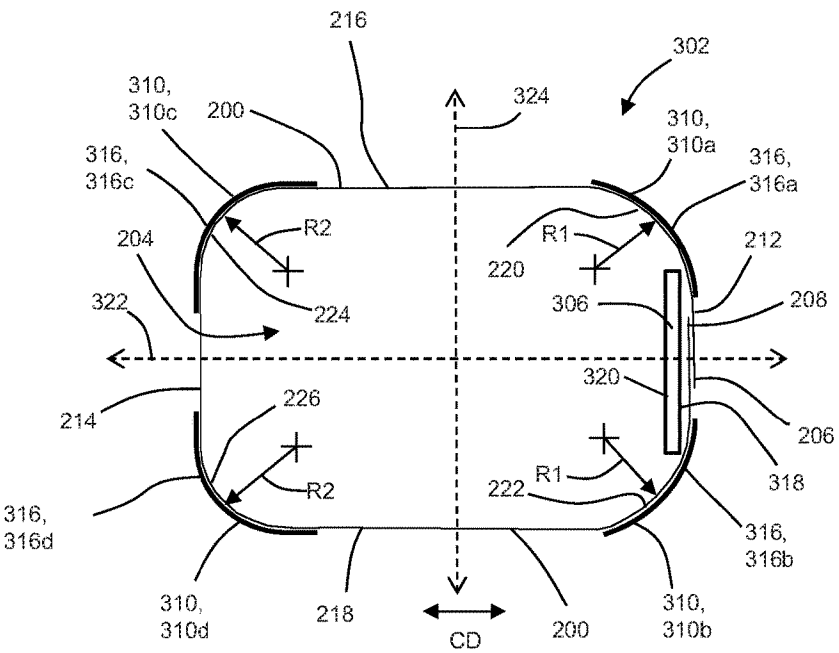
FIG. 8B is a front side view of the opening formed by film advancing around the first, second, third, and fourth edges of FIG. 8A.

As discussed above, during the packaging operation, film 200 advances around the forming members to define an opening. For example, FIG. 8B shows the opening formed by film advancing around the first, second, third, and fourth edges of FIG. 8A. As shown in FIG. 8B, the opening 202 comprises a first side 212 and an opposing second side 214, and a third side 216 and an opposing fourth side 218. Because the edges 316 of the forming members 310 may be configured to be symmetrical about the first axis 322 and asymmetrical about second axis 324, the opening 204 formed by the film 200 advancing around the corresponding edges 316 is symmetrical about the first axis 322 and asymmetrical about second axis 324. As such, the opening 204 may be symmetrical about the first axis 322 that bisects the first side 212 and the second side 214. And the opening 204 may be asymmetrical about the second axis 324 that bisects the third side 216 and the fourth side 218.

As previously mentioned, the first edge 316*a*, second edge 316*b*, third edge 316*c*, and fourth edge 316*d* may define various shapes and sizes, and thus, the opening 204 may include correspondingly shaped corner regions. For example, in some configurations, the second side 214 may be connected directly with and perpendicular to the third side 216 and the fourth side 218. In some configurations, such as shown in FIG. 8B, the opening 204 may include a first arcuate corner 220, a second arcuate corner 222, a third arcuate corner 224, and a fourth arcuate corner 226. As such, the first arcuate corner 220 may connect the first side 212 with the third side 216, and the second arcuate corner 222 may connect the first side 212 with the fourth side 218. In addition, the third arcuate 224 corner may connect the second side 214 with the third side 216, and the fourth arcuate corner 226 may connect the second side 214 with the fourth side 218. In turn, the first arcuate corner 220 and the second arcuate corner 222 may each comprise the first radius, R1, of curvature. And the third arcuate corner 224 and the fourth arcuate corner 226 may each comprise the second radius, R2, of curvature; wherein the first radius R1 of curvature is not equal to the second radius R2 of curvature. In some configurations, the ratio of the second radius R2 of curvature of the third and fourth corners 224, 226 of the opening 204 to the first radius R1 of curvature of the first and second corners 220, 222 of the opening 204 may be greater than or equal to about 0.3 and less than 1.0, specifically reciting all 0.05 increments within the above-recited ranges and all ranges formed therein or thereby. In some configurations, the ratio of the second radius R2 of curvature of the third and fourth corners 224, 226 of the opening 204 to the first radius R1 of curvature of the first and second corners 220, 222 of the opening 204 may also be greater than 1.0 and less than or equal to about 1.5, specifically reciting all 0.05 increments within the above-recited ranges and all ranges formed therein or thereby.

Figure 8C:
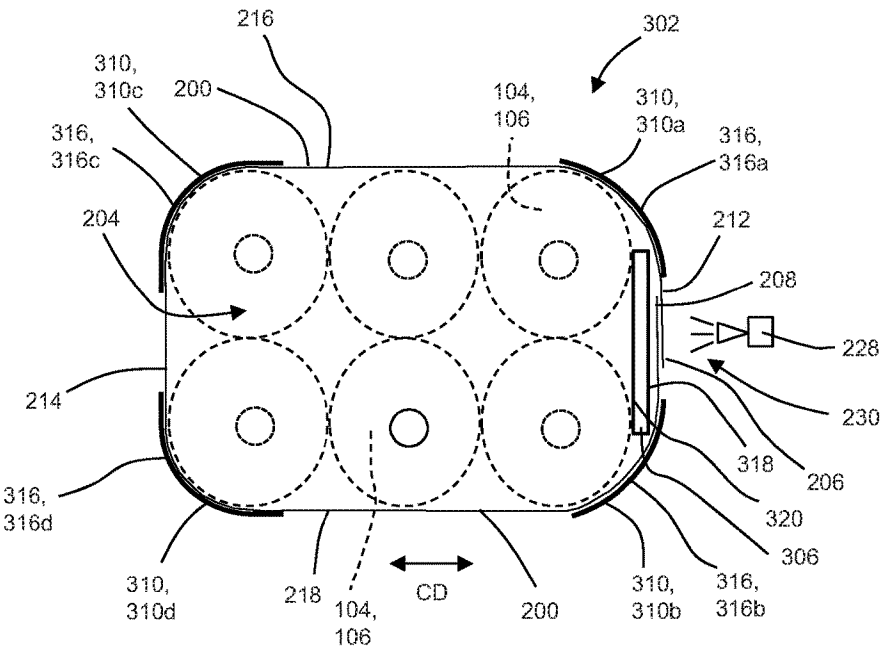
FIG. 8C is a cross sectional view of absorbent paper products advancing through the opening of film of FIG. 8B.

Referring now to FIG. 8C, a cross sectional view of rolled paper products 106 is shown advancing through the opening 204 of the tube 202 of film 200 shown in FIG. 8B. As shown in FIG. 8C, the film 200 is positioned between absorbent paper product 104 and the third and fourth forming members 310*c*, 310*d*, and the sealing member 306 is positioned between absorbent paper product 104 and the film 200. The overlapped first longitudinal edge 206 and the second longitudinal edge 208 of the film 200 that define a portion of the first side 212 of the opening 204 may be sealed to each other on the first surface 318 of the sealing member 306. As shown in FIG. 8C, the packaging apparatus 300 may include a nozzle 228 that directs heated air 230 onto the overlapped longitudinal edges 206, 208 of the film 200 to melt fuse the film 200 together and form a seal, such as the side seal 114 discussed above. In some configurations, the sealing member 306 may also be configured with a vacuum pressure system to evacuate air from inside the tube 202. The sealing member 306 may also be oriented such that the second surface 320 presses against the rolled paper product 106 advancing through the opening 204. As such, the second surface 320 of the sealing member 306 may deflect the rolled paper product 106 in the cross direction CD onto the advancing film 200 advancing along the inner surfaces 314*c*, 314*d* of the third forming member 310*c* and the fourth forming member 310*d*. Once the rolled paper product 106 has advanced downstream and past the sealing member 306, the rolled paper product 106 may then expand in the cross direction CD and resume substantially the same shape of the rolled paper product 106 upstream of the opening 204 and/or the sealing member 306.

With reference to FIGS. 2-8C, the former 302 may be configured such that the rolled paper products 106 and film 200 advancing through the opening 204 may be pressed against the third and fourth forming members 310*c*, 310*d*. Thus, the edges 316*c*, 316*d* and/or inner surfaces 314*c*, 314*d* of the third and fourth forming members 310*c*, 310*d* may be shaped to correspond with the shapes of the outer surfaces of the roller paper products 106 advancing through the former 302. Conversely, the former 302 may be configured such that the rolled paper products 106 advancing through the opening 204 may be pressed against the sealing member 306 and may not be pressed against the edges 316*a*, 316*b* and/or inner surfaces 314*a*, 314*b* of the first and second forming members 310*a*, 310*b*. Thus, the edges 316*a*, 316*b* and/or inner surfaces 314*a*, 314*b* of the first and second forming members 310*a*, 310*b* may not necessarily be shaped to correspond with the shapes of the outer surfaces of the rolled paper products 106 advancing through the former 302. In turn, the first and second forming members 310*a*, 310*b* may be shaped to provide a relatively shorter film travel path than otherwise might be required if the forming members 310 were all shaped to correspond with the advancing rolled paper product 106. Thus, a relatively tighter film wrap may be achieved.

Roll Density Test Method

For this test, the rolled paper product roll is the test sample. Remove all of the test rolled paper product rolls from any packaging and allow them to condition at about 23° C.±2° C.° and about 50%±2% relative humidity for 24 hours prior to testing. Rolls with cores that are crushed, bent or damaged should not be tested.

The Roll Density is calculated by dividing the mass of the roll by its volume using the following equation:

$$\text{Roll Density}\left(\frac{\text{g}}{\text{cm}^3}\right) = \frac{\text{Mass (g)}}{\text{Roll Width (cm)} \cdot \pi[\text{Outer Radius (cm)}^2 - \text{Inner Radius (cm)}^2]}$$

Figure 9:
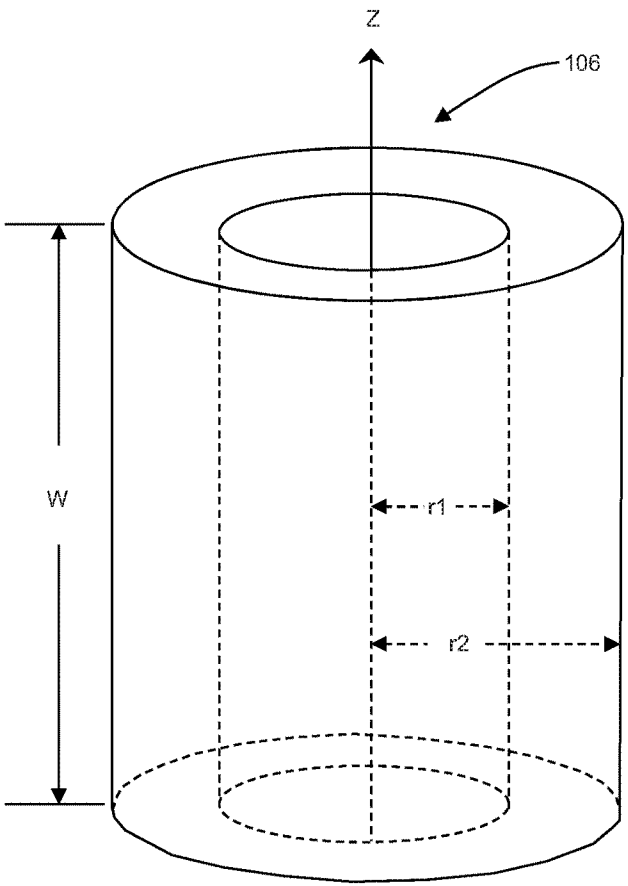
FIG. 9 is a schematic representation of a rolled paper product roll for use in measuring a rolled paper product roll's Roll Density as measured according to the Roll Density Test Method described herein.

FIG. 9 visually describes the measurement of a rolled paper product roll 10 where Z is the center axis of the roll, where the outer radius $r_2$ in units of cm is measured using the Roll Diameter Test Method described herein, the inner radius $r_1$ in units of cm is measured using a caliper tool inside the core, the roll width W is measured using a ruler or tape measure in units of cm and the mass in units of g is the weight of the entire roll including core.

In like fashion analyze a total of ten (10) replicate sample rolls. Calculate the arithmetic mean of the 10 values and report the Roll Density to the nearest 0.001 g/cm$^3$.

Roll Diameter Test Method

For this test, the actual rolled paper product roll is the test sample. Remove all of the test rolled paper product rolls from any packaging and allow them to condition at about 23° C.±2° C. and about 50%±2% relative humidity for 24 hours prior to testing. Rolls with cores that are crushed, bent or damaged should not be tested.

The diameter of the test rolled paper product roll is measured directly using a Pi® tape of appropriate length or equivalent precision diameter tape (e.g. an Executive Diameter tape available from Apex Tool Group, LLC, Apex, N.C., Model No. W606PD) which converts the circumferential distance into a diameter measurement, so the roll diameter is directly read from the scale. The diameter tape is graduated to 0.01 inch increments. The tape is 0.25 inches wide and is made of flexible metal that conforms to the curvature of the test sanitary tissue product roll but is not elongated under the loading used for this test.

Loosely loop the diameter tape around the circumference of the test rolled paper product roll, placing the tape edges directly adjacent to each other with the surface of the tape lying flat against the test rolled paper product roll. Pull the tape snug against the circumference of the test rolled paper product roll, applying approximately 100 g of force. Wait 3 seconds. At the intersection of the diameter tape, read the diameter aligned with the zero mark of the diameter tape and record as the Roll Diameter to the nearest 0.01 inches. The outer radius of the rolled paper product roll is also calculated from this test method.

In like fashion analyze a total of ten (10) replicate sample rolled paper product rolls. Calculate the arithmetic mean of the 10 values and report the Roll Diameter to the nearest 0.01 inches.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for wrapping absorbent paper product, the method comprising:

providing a first forming member comprising a first edge, a second forming member comprising a second edge, a third forming member comprising a third edge, and a fourth forming member comprising a fourth edge;

forming an opening by advancing a continuous sheet of film over the first, second, third, and fourth edges, wherein the opening comprises a first side and an opposing second side, and a third side and an opposing fourth side, wherein the opening is symmetrical about a first axis that bisects the first side and the second side, and wherein the opening is asymmetrical about a second axis that bisects the third side and the fourth side;

providing a sealing member extending in a machine direction downstream from the opening;

advancing absorbent paper product in the machine direction through the opening, wherein the continuous sheet of film is positioned between absorbent paper product and the third and fourth forming members, and wherein the sealing member is positioned between absorbent paper product and the continuous sheet of film;

overlapping first and second edge regions of the continuous sheet of film on the sealing member;

bonding the first and second edge regions of the continuous sheet of continuous sheet of film together;

wherein the opening further comprises: a first arcuate corner connecting the first side with the third side; and a second arcuate corner connecting the first side with the fourth side;

wherein the opening further comprises: a third arcuate corner connecting the second side with the third side; and a fourth arcuate corner connecting the second side with the fourth side;

wherein the first arcuate corner and the second arcuate corner comprise a first radius of curvature; wherein the third arcuate corner and the fourth arcuate corner comprise a second radius of curvature; and wherein the first radius of curvature is not equal to the second radius of curvature; and wherein a ratio of the second radius of curvature to the first radius of curvature is greater than or equal to about 0.3 and less than 1.0.

2. The method of claim 1, wherein the second side is connected directly with and perpendicular to the third side and the fourth side.

3. The method of claim 1, wherein a ratio of the second radius of curvature to the first radius of curvature is greater than 1.0 and less than or equal to about 1.5.

4. The method of claim 1, wherein the absorbent paper product comprises rolled paper product comprising a core extending along a longitudinal axis.

5. The method of claim 4, further comprising advancing the rolled paper product through the opening with the longitudinal axis parallel with the machine direction.

6. The method of claim 1, further comprising advancing the rolled paper product through the opening with the longitudinal axis perpendicular to the machine direction.

7. The method of claim 1, further comprising changing a size of the opening by moving the first, second, third, and fourth forming members relative to each other.

8. The method of claim 1, wherein the first forming member comprises an outer surface connected with an inner surface along the first edge; the second forming member comprises an outer surface connected with an inner surface along the second edge; the third forming member comprises an outer surface connected with an inner surface along the third edge; and the fourth forming member comprising an outer surface connected with an inner surface along the fourth edge.

9. The method of claim 8, further comprising advancing the continuous sheet of film in a second direction opposite the machine direction on the outer surfaces of the first, second, third, and fourth forming members to the first, second, third, and fourth edges.

10. The method of claim 9, advancing the continuous sheet of film in the machine direction from the first, second, third, and fourth edges along the inner surfaces of the first, second, third, and fourth forming members.

11. A packaging apparatus for forming a continuous sheet of film into a tube shape extending in a machine direction, the packaging apparatus comprising:

a first forming member comprising an outer surface connected with an inner surface along a first edge;

a second forming member comprising an outer surface connected with an inner surface along a second edge;

a third forming member comprising an outer surface connected with an inner surface along a third edge;

a fourth forming member comprising an outer surface connected with an inner surface along a fourth edge;

wherein the first, second, third, and fourth forming members are arranged so as to define an opening when film is folded over the first, second, third, and fourth edges;

wherein the opening comprises a first side and an opposing second side, and a third side and an opposing fourth side;

wherein the opening is symmetrical about a first axis that bisects the first side and the second side, and wherein the opening is asymmetrical about a second axis that bisects third side and the fourth side;

wherein the opening further comprises: a first arcuate corner connecting the first side with the third side; and a second arcuate corner connecting the first side with the fourth side;

wherein the first arcuate corner and the second arcuate corner comprise a first radius of curvature; wherein the third arcuate corner and the fourth arcuate corner comprise a second radius of curvature; and wherein the first radius of curvature is not equal to the second radius of curvature; and wherein a ratio of the second radius of curvature to the first radius of curvature is greater than or equal to about 0.3 and less than 1.0.

12. The packaging apparatus of claim 11, wherein the second side is connected directly with and perpendicular to the third side and the fourth side.

13. The packaging apparatus of claim 11, wherein the opening further comprises: a third arcuate corner connecting the second side with the third side; and a fourth arcuate corner connecting the second side with the fourth side.

14. The packaging apparatus of claim 11, wherein a ratio of the second radius of curvature to the first radius of curvature is greater than 1.0 and less than or equal to about 1.5.

15. The packaging apparatus of claim 11, wherein the first, second, third, and fourth forming members are movable relative to each other.

16. The packaging apparatus of claim 11, further comprising a sealing member extending in the machine direction downstream from the opening, the sealing member comprises a first surface and an opposing second surface; and wherein the first surface of the sealing member is in a facing relationship with the inner surfaces of the first forming member and the second forming member, and wherein the second surface of the sealing member is in a facing relationship with the inner surfaces of the third forming member and the fourth forming member.

17. A packaging apparatus for forming a continuous sheet of film into a tube shape extending in a machine direction, the packaging apparatus comprising:

a first forming member comprising a first edge;

a second forming member comprising a second edge;

a third forming member comprising a third edge;

a fourth forming member comprising a fourth edge;

wherein the first, second, third, and fourth edges are arranged to define an opening when film is folded over the first, second, third, and fourth edges;

wherein the first edge and the second edge are symmetrical with respect to each other about a first axis extending between first edge and the second edge, and wherein the first edge and the third edge are asymmetrical with respect to each other about a second axis extending between the first edge and the third edge;

wherein the first edge and the second edge comprise a first radius of curvature; wherein the third edge and the fourth edge comprise a second radius of curvature; and wherein the first radius of curvature is not equal to the second radius of curvature; and wherein a ratio of the second radius of curvature to the first radius of curvature is greater than or equal to about 0.3 and less than 1.0.

18. The packaging apparatus of claim 17, wherein a ratio of the second radius of curvature to the first radius of curvature is greater than 1.0 and less than or equal to about 1.5.

19. A packaging apparatus for forming a continuous sheet of film into a tube shape extending in a machine direction, the packaging apparatus comprising:

a first forming member comprising a first corner member releasably connected with a first base member, the first corner member comprising a first edge;

a second forming member comprising a second corner member releasably connected with a second base member, the second corner member comprising a second edge;

a third forming member comprising a third edge;

a fourth forming member comprising a fourth edge;

wherein in a first configuration, the first edge, second edge, third edge, and fourth edge are arranged to define a first opening when film is folded over the first edge, second edge, third edge, and fourth edge; and wherein in a second configuration, the first corner member and the second corner member are removed and replaced with a first replacement corner member and a second replacement corner member, wherein the first replacement corner member comprises a first replacement edge and the second replacement corner member comprises a second replacement edge, such that the first replacement edge, second replacement edge, third edge, and fourth edge are arranged to define a second opening when film is folded over the first replacement edge, second replacement edge, third edge, and fourth edge.

20. The packaging apparatus of claim 19, wherein the first opening defines a first shape and the second opening defines a second shape, wherein the first shape is different than the second shape.

21. The packaging apparatus of claim 19, wherein the first opening defines a first size and the second opening defines a second size, wherein the first size is different than the second size.

22. The packaging apparatus of claim 19, further comprising a magnet releasably connecting the first corner member releasably connected with the first base member.

23. A method for wrapping absorbent paper product, the method comprising:

providing a first forming member comprising a first edge, a second forming member comprising a second edge, a third forming member comprising a third edge, and a fourth forming member comprising a fourth edge;

forming an opening by advancing a continuous sheet of film over the first, second, third, and fourth edges, wherein the opening comprises a first side and an opposing second side, and a third side and an opposing fourth side, wherein the opening is symmetrical about a first axis that bisects the first side and the second side, and wherein the opening is asymmetrical about a second axis that bisects the third side and the fourth side;

providing a sealing member extending in a machine direction downstream from the opening;

advancing absorbent paper product in the machine direction through the opening, wherein the continuous sheet of film is positioned between absorbent paper product and the third and fourth forming members, and wherein the sealing member is positioned between absorbent paper product and the continuous sheet of film;

overlapping first and second edge regions of the continuous sheet of film on the sealing member;

bonding the first and second edge regions of the continuous sheet of continuous sheet of film together;

wherein the opening further comprises: a first arcuate corner connecting the first side with the third side; and a second arcuate corner connecting the first side with the fourth side;

wherein the opening further comprises: a third arcuate corner connecting the second side with the third side; and a fourth arcuate corner connecting the second side with the fourth side;

wherein the first arcuate corner and the second arcuate corner comprise a first radius of curvature; wherein the third arcuate corner and the fourth arcuate corner comprise a second radius of curvature; and wherein the first radius of curvature is not equal to the second radius of curvature; and wherein a ratio of the second radius of curvature to the first radius of curvature is greater than 1.0 and less than or equal to about 1.5.

24. The method of claim 23, wherein the second side is connected directly with and perpendicular to the third side and the fourth side.

25. The method of claim 23, wherein a ratio of the second radius of curvature to the first radius of curvature is greater than or equal to about 0.3 and less than 1.0.

26. The method of claim 23, wherein the absorbent paper product comprises rolled paper product comprising a core extending along a longitudinal axis.

27. The method of claim 23, further comprising advancing the rolled paper product through the opening with the longitudinal axis parallel with the machine direction.

28. The method of claim 23, further comprising advancing the rolled paper product through the opening with the longitudinal axis perpendicular to the machine direction.

29. The method of claim 23, further comprising changing a size of the opening by moving the first, second, third, and fourth forming members relative to each other.

30. The method of claim 23, wherein the first forming member comprises an outer surface connected with an inner surface along the first edge; the second forming member comprises an outer surface connected with an inner surface along the second edge; the third forming member comprises an outer surface connected with an inner surface along the third edge; and the fourth forming member comprising an outer surface connected with an inner surface along the fourth edge.

31. The method of claim 30, further comprising advancing the continuous sheet of film in a second direction opposite the machine direction on the outer surfaces of the first, second, third, and fourth forming members to the first, second, third, and fourth edges.

32. The method of claim 31, advancing the continuous sheet of film in the machine direction from the first, second, third, and fourth edges along the inner surfaces of the first, second, third, and fourth forming members.

33. A packaging apparatus for forming a continuous sheet of film into a tube shape extending in a machine direction, the packaging apparatus comprising:

a first forming member comprising an outer surface connected with an inner surface along a first edge;

a second forming member comprising an outer surface connected with an inner surface along a second edge;

a third forming member comprising an outer surface connected with an inner surface along a third edge;

a fourth forming member comprising an outer surface connected with an inner surface along a fourth edge;

wherein the first, second, third, and fourth forming members are arranged so as to define an opening when film is folded over the first, second, third, and fourth edges;

wherein the opening comprises a first side and an opposing second side, and a third side and an opposing fourth side;

wherein the opening is symmetrical about a first axis that bisects the first side and the second side, and wherein the opening is asymmetrical about a second axis that bisects third side and the fourth side;

wherein the opening further comprises: a first arcuate corner connecting the first side with the third side; and a second arcuate corner connecting the first side with the fourth side;

wherein the first arcuate corner and the second arcuate corner comprise a first radius of curvature; wherein the third arcuate corner and the fourth arcuate corner comprise a second radius of curvature; and wherein the first radius of curvature is not equal to the second radius of curvature; and wherein a ratio of the second radius of curvature to the first radius of curvature is greater than 1.0 and less than or equal to about 1.5.

34. The packaging apparatus of claim 33, wherein a ratio of the second radius of curvature to the first radius of curvature is greater than or equal to about 0.3 and less than 1.0.

35. A packaging apparatus for forming a continuous sheet of film into a tube shape extending in a machine direction, the packaging apparatus comprising:

a first forming member comprising a first edge;

a second forming member comprising a second edge;

a third forming member comprising a third edge;

a fourth forming member comprising a fourth edge;

wherein the first, second, third, and fourth edges are arranged to define an opening when film is folded over the first, second, third, and fourth edges;

wherein the first edge and the second edge are symmetrical with respect to each other about a first axis extending between first edge and the second edge, and wherein the first edge and the third edge are asymmetrical with respect to each other about a second axis extending between the first edge and the third edge;

wherein the first edge and the second edge comprise a first radius of curvature; wherein the third edge and the fourth edge comprise a second radius of curvature; and wherein the first radius of curvature is not equal to the second radius of curvature; and wherein a ratio of the second radius of curvature to the first radius of curvature is greater than 1.0 and less than or equal to about 1.5.

36. The packaging apparatus of claim 35, wherein a ratio of the second radius of curvature to the first radius of curvature is greater than or equal to about 0.3 and less than 1.0.

* * * * *